US005934325A

United States Patent [19]

Brattoli et al.

[11] Patent Number: 5,934,325

[45] Date of Patent: Aug. 10, 1999

[54] PULLOUT FAUCET WAND JOINT

[75] Inventors: Michael A. Brattoli, Elyria; Cynthia A. George, Bay Village, both of Ohio

[73] Assignee: Moen Incorporated, North Olmsted, Ohio

[21] Appl. No.: 09/156,194

[22] Filed: Sep. 17, 1998

[51] Int. Cl.[6] ..... E03C 1/04

[52] U.S. Cl. ..... 137/801; 4/678; 239/588

[58] Field of Search ..... 4/678; 137/801; 239/588

[56] References Cited

U.S. PATENT DOCUMENTS

| | | | |
|---|---|---|---|
| 5,073,991 | 12/1991 | Marty . | |
| 5,090,062 | 2/1992 | Hochstrasser | 137/801 X |
| 5,213,268 | 5/1993 | Gnauert et al. . | |
| 5,361,431 | 11/1994 | Freier et al. . | |
| 5,546,978 | 8/1996 | Parker . | |
| 5,575,424 | 11/1996 | Fleischmann | 239/588 X |
| 5,744,033 | 4/1998 | Bertrand et al. | 137/625.5 X |

*Primary Examiner*—Gerald A. Michalsky

*Attorney, Agent, or Firm*—Dorn, McEachran, Jambor & Keating

[57] ABSTRACT

A pullout faucet wand joint includes a receptor formed and adapted to be mounted on a sink deck, with the receptor having an opening to receive a faucet wand and an interior passage for a faucet hose which is attached to the faucet wand. The wand joint includes a reinforcing collar secured to the receptor at its opening, which collar extends axially into the receptor internal passage to provide reinforcement for the wand when it is positioned within the receptor. The faucet wand has a shell and there is a faucet waterway located within the shell. A transition sleeve is secured about the exterior of the waterway with the transition sleeve extending within the wand shell and having cooperating elements thereon which prevent relative rotation between the wand shell and the transition sleeve. There are cooperating elements on the wand shell and the reinforcing collar which provide orientation therebetween when the shell is inserted within the receptor.

16 Claims, 2 Drawing Sheets

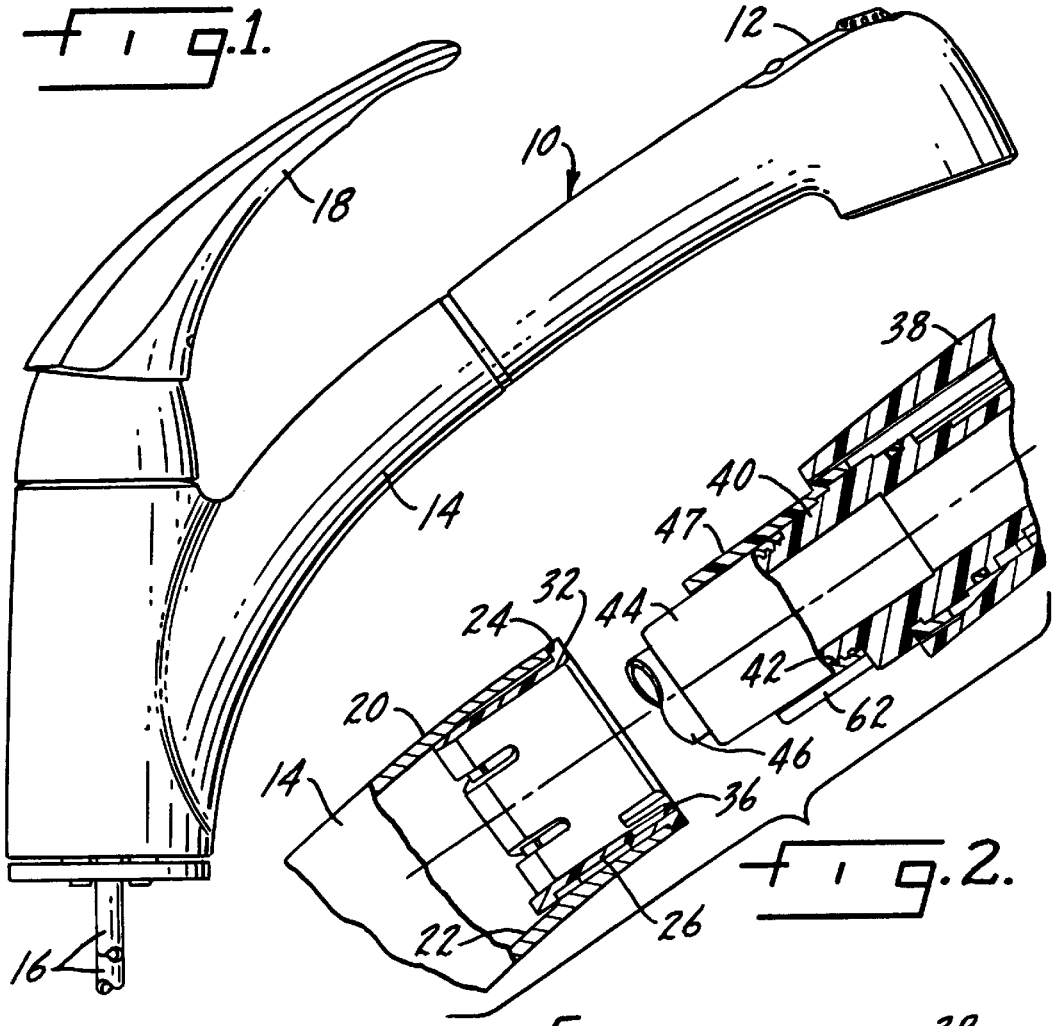
Fig.1.
12
10
18
14
16
38
40
47
32
44
24
42
62
20
46
14
36
22
26
Fig.2.
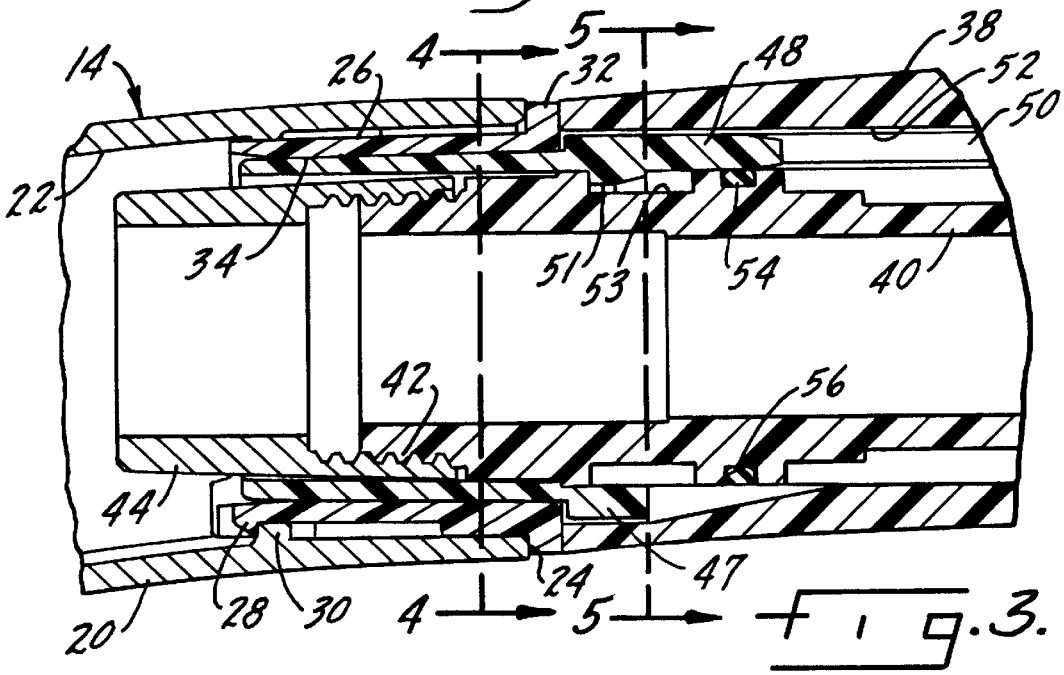
14
26
4
5
32
48
38
52
50
22
34
51
53
54
40
42
56
44
24
47
20
28
30
4
5
Fig.3.

Fig. 4.
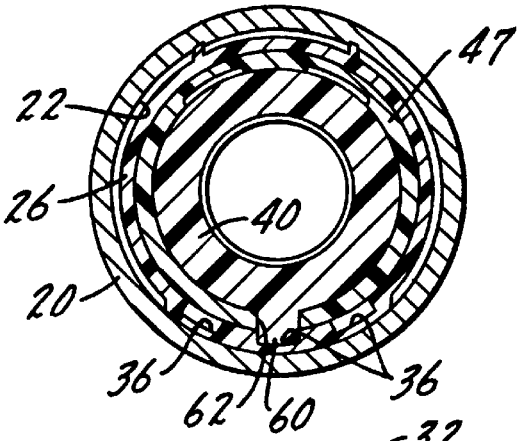
Fig. 5.
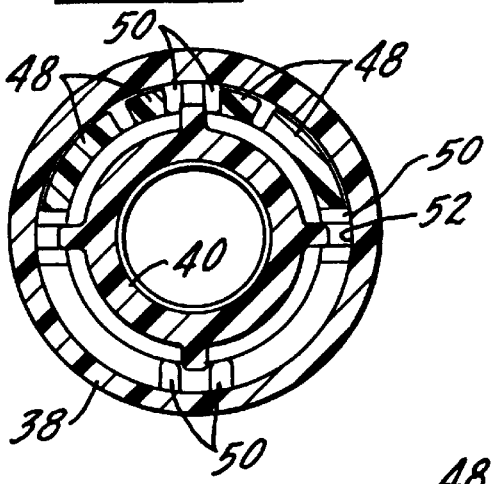
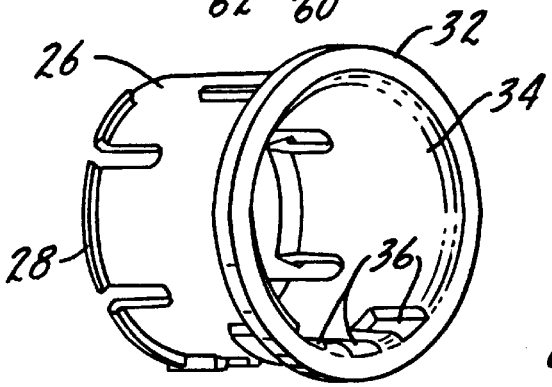
Fig. 6.
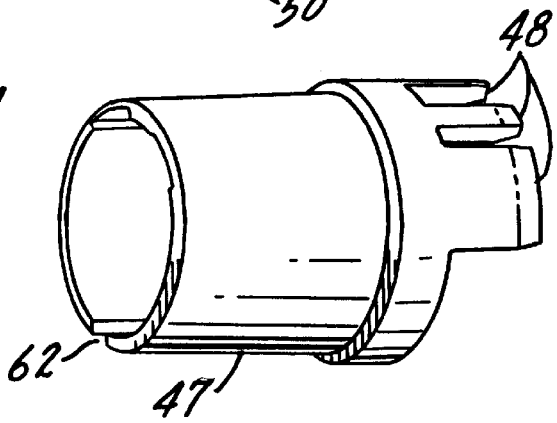
Fig. 7.
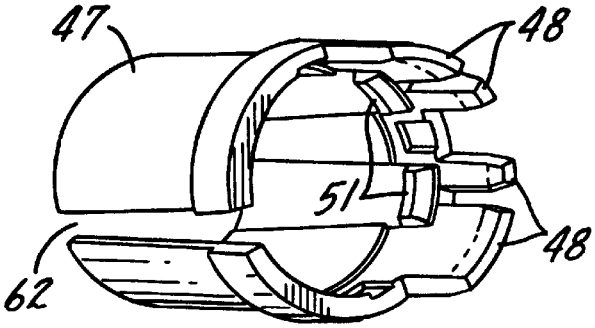
Fig. 8.
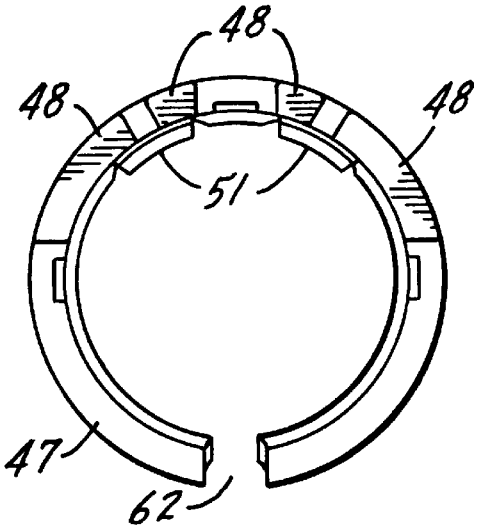
Fig. 9.

PULLOUT FAUCET WAND JOINT

THE FIELD OF THE INVENTION

The present invention relates to pullout faucet assemblies of the type in which a wand is connected by a flexible hose to the water supply which provides for the consumer a water delivery system allowing flexibility in supplying water to various parts of the sink. In existing faucets of this type, the faucet wand is connected to the flexible hose by a nut which threads onto the internal waterway of the wand. This provides the only support to the wand assembly when it is positioned within its receptor. Breakage of this joint typically occurs at the threads on the waterway. The present invention provides a receptor joint with increased strength against side loading and improved resistance to rotational torque by relocating the load away from the above-described threaded joint. The particular joint assembly is advantageous in that it removes stress from the threads of the internal waterway and it spreads the side load stresses across the entire hose/wand joint through the provision of a reinforcing collar and transition sleeve.

SUMMARY OF THE INVENTION

The present invention relates to pullout faucet assemblies and more particularly to a faucet wand joint which has improved durability against side loading and rotational torque.

A primary purpose of the invention is a wand faucet joint between the wand shell and the receptor which has increased strength.

Another purpose is a faucet wand joint which removes the stress of the hose/wand joint from the threads of the internal waterway.

Another purpose is a receptor wand joint which spreads the side load stresses across a substantial axial distance so as to reduce potential breakage during normal use of the faucet wand.

Another purpose is a transition sleeve for use in a wand assembly which insures that there is a secure connection to the wand waterway while also providing rotational location between the wand shell and the joint.

Another purpose is a transition sleeve/waterway assembly for the use described which increases rotational torque resistance within the wand shell to prevent failure of this joint during normal use.

Another purpose is a reinforcing collar positioned on a wand receptor, which collar relieves stress on the hose/wand threaded joint.

Other purposes will appear in the ensuing specification, drawings and claims.

BRIEF DESCRIPTION OF THE DRAWINGS

The invention is illustrated diagrammatically in the following drawings wherein:

FIG. 1 is a side view of the pullout wand faucet assembly of the present invention;

FIG. 2 is an enlarged exploded view illustrating the connection between the receptor and the faucet wand;

FIG. 3 is an enlarged axial section through the faucet wand/receptor joint assembly, rotated 45 degrees in relation to FIG. 2;

FIG. 4 is a section along plane 4—4 of FIG. 3;

FIG. 5 is a section along plane 5—5 of FIG. 3;

FIG. 6 is a perspective of the reinforcing collar which is secured to the receptor;

FIG. 7 is a rear perspective of the transition sleeve;

FIG. 8 is a front perspective of the transition sleeve; and

FIG. 9 is a bottom view of the transition sleeve.

DESCRIPTION OF THE PREFERRED EMBODIMENT

In FIG. 1 the faucet assembly includes a pullout wand 10 having a hand-operated trigger 12 for use in varying the type of water discharge from the wand. The wand 10 is mounted to a receptor 14 which may have hot and cold water input conduits indicated at 16. There is a handle 18 which, upon rotation and rocking or tilting; movement, will control the volume and temperature of the water which is passed to the wand 10. Typically, a mixing valve, for example a mixing valve sold by Moen Incorporated, the assignee of the present application, under the trademarks "1200" and "1225" may be positioned within the receptor 14 with the operation of the valve being controlled by manipulation of the handle 18.

FIG. 2 illustrates, in exploded fashion, the connection between the wand and the receptor. The receptor 14 has a body 20 with an internal passage 22 and an open end 24. A reinforcing collar 26, illustrated in FIG. 6, is attached to the open end 24 of the receptor body 20. The reinforcing collar 26 has a discontinuous arcuate hook-like projection 28 at its internal end, which discontinuous projection interacts with an inwardly directed annular projection or shoulder 30 (FIG. 3) on the interior of the receptor shell 20. Thus, the reinforcing collar 26 is anchored to the receptor. Collar 26 also has an outwardly directed annular flange 32 which will be seated upon the end 24 of the receptor shell 20, as particularly shown in FIGS. 2 and 3. The reinforcing collar is firmly anchored to the receptor and its internal surface 34 provides a load spreading support for the wand 10. Preferably, the collar 26 will be formed of a suitable plastic and has a plurality, for example three, axially extending notches 36 (FIG. 6) which are used to orient or locate the wand when it is placed within the receptor.

The wand 10 includes a shell 38 within which is positioned a generally cylindrical waterway 40. The waterway 40 provides a water passage to the discharge area of the wand and has a threaded section 42 at its internal end to receive a hose nut 44 which will be used to attach the hose 46, shown in FIG. 2, to the wand. The hose is flexible and will be drawn out of the receptor when the wand is pulled out for use in the sink.

Circumferentially surrounding a portion of the waterway 40 is a transition sleeve 47 which has a plurality of differentially spaced and sized outwardly extending tabs 48 which will interact with inwardly directed ribs 50 on the inside of the wand shell 38. As shown particularly in the section of FIG. 5, the ribs 50 define a space between each pair of ribs, with the tabs 48 being received within the space 52 between the pairs of ribs 50. This interlocking arrangement precludes relative rotation between the wand shell and the transition sleeve which in turn is rotationally fixed to the waterway 40.

The transition sleeve 47, as illustrated in the section of FIG. 3 and in the perspective of FIG. 8, has two flexible snap-on locking tabs 51 which will snap over a portion of the waterway 40 and will be received within an annular recess 53 formed on the exterior of the waterway. This connects the transition sleeve to the waterway. A seal ring 54 is positioned within an exterior groove 56 on the waterway and provides centering of the waterway against the internal surface of the transition sleeve and the inwardly-directed ribs 50 on the inside of the wand shell 38.

As particularly shown in the section of FIG. 4, the waterway 40 has an axially extending outwardly directed projection 60 which will extend within an axially extending slot 62 on the transition sleeve and will further extend into one of the three locating notches 36 on the interior of the reinforcing collar 26 to prevent rotation between the transition sleeve and waterway and to provide proper orientation of the wand within its supporting receptor.

When the faucet wand of the present invention is being assembled, the transition sleeve is first pushed onto the wand waterway until the two snap-on locking tabs are located within the recess 52. Rotary orientation is provided by the axial projection 60 and the axial groove or space 62 in the transition sleeve. The assembled transition sleeve and waterway are then inserted into the wand shell with the tabs 48 on the sleeve being positioned within the spaces 52 formed between the locating ribs on the inside surface of the shell. The reinforcing collar 26 is assembled to the faucet receptor, snapping into the receptor to the position illustrated in FIGS. 2 and 3. The three orientation notches on the inside of the reinforcing collar can provide three different specific orientations of the wand assembly when it is placed in the receptor insert.

The side load forces applied to the wand, when assembled as described and positioned into the faucet receptor and the reinforcing collar, are dispersed throughout the length of the collar and the transition sleeve. This dispersal spreads the load in both directions from the threaded connection between the hose nut 44 and the wand waterway 40, thereby isolating this threaded connection from the forces which may be applied sideways to the wand. Further, the load is distributed into the receptor and the reinforcing collar, the transition sleeve, and to the wand shell, thus insuring that there will be no breakage at the threaded joint as has been common in prior art faucet wands of this general configuration. There is also resistance to rotational torque by relocating the load which might be applied to the wand away from the threaded connection between the wand and the hose. The resistance to torque is provided not only by the interaction of the axial projection on the waterway and the transition sleeve, but also by the interaction between the tabs and ribs on the transition sleeve and the wand shell.

The invention has been depicted in the drawings and described herein as utilizing a separate transition sleeve and waterway, with these two elements being attached to the wand shell. It is equally within the scope of the invention to have the transition sleeve and waterway be a single integral element. This combined transition sleeve and waterway would then be attached in a suitable manner to the inside of the wand shell. The interaction between such a combined element and the reinforcing collar of the receptor would be as described above. Similarly, the transition sleeve may be integral with the wand shell, thus combining the functions of the transition sleeve, waterway and wand shell into a single integrated element. Again, the function of such an integrated element with the receptor and its reinforcing collar would be as described herein.

Whereas the preferred form of the invention has been shown and described herein, it should be realized that there may be many modifications, substitutions and alterations thereto.

The embodiments of the invention in which an exclusive property or privilege is claimed are defined as follows:

1. A pullout faucet wand joint including a receptor formed and adapted to be mounted on a sink deck, said receptor having an opening to receive a faucet wand and an internal passage for a faucet hose to be attached to the faucet wand, said wand joint including a reinforcing collar secured to the receptor at its opening and extending, axially into said receptor internal passage, a faucet wand shell, a faucet wand waterway located within said shell, a transition sleeve secured about the exterior of said waterway, said transition sleeve extending within said wand shell and having means thereon cooperating with an inside surface of said wand shell to prevent relative rotary movement between said wand shell and transition sleeve, and cooperating means on said wand shell and reinforcing collar to provide orientation therebetween when said wand shell is inserted in said receptor.

2. The pullout faucet wand joint of claim 1 wherein the cooperating means on the transition sleeve and inside surface of the wand shell include cooperating projections on each of said transition sleeve and the inside surface of said wand shell.

3. The pullout faucet wand joint of claim 2 wherein said cooperating projections include outwardly extending tabs on the exterior of said transition sleeve and internal ribs formed on the inside surface of said wand shell.

4. The pullout faucet wand joint of claim 1 wherein said reinforcing collar includes an outwardly extending arcuate projection at one end thereof, which projection cooperates with an inwardly directed rib on an inside surface of said receptor to secure said elements one to the other.

5. The pullout faucet wand joint of claim 4 wherein said reinforcing collar includes a further outwardly extending projection overlying the end of said receptor.

6. The pullout faucet wand joint of claim 1 wherein said faucet wand waterway includes an outwardly extending axial projection which cooperates with an axially extending slot on said transition sleeve to provide relative orientation therebetween.

7. The pullout faucet wand joint of claim 6 wherein said axial slot extends the entire length of said transition sleeve.

8. The pullout faucet wand joint of claim 6 wherein said reinforcing collar has at least one orientation notch formed on the interior surface thereof, with said faucet wand waterway axial projection extending into an orientation notch to provide relative orientation between the faucet wand and receptor.

9. The pullout faucet wand joint of claim 1 wherein said transition sleeve includes locking tabs thereon, which locking tabs are received in cooperating recesses on said waterway to provide attachment therebetween.

10. The pullout faucet wand joint of claim 9 wherein said tabs are located intermediate opposite ends of said transition sleeve.

11. The pullout faucet wand joint of claim 1 further including a hose nut for use in attaching the hose to the wand waterway, with an end of said waterway having threads thereon cooperating with said hose nut.

12. A pullout faucet wand joint including a receptor formed and adapted to be mounted on a sink deck, said receptor having an opening to receive a faucet wand and an internal passage for a faucet hose to be attached to the faucet wand, said wand joint including a reinforcing collar secured to the receptor at its opening and extending axially into said receptor internal passage, a faucet wand shell having a waterway located therein and a transition sleeve extending from said wand shell and into sliding engagement with an interior surface of said reinforcing collar, said reinforcing collar and transition sleeve cooperating to support said wand in said receptor, and cooperating means on said transition sleeve and an inside surface of said wand shell to prevent relative rotation therebetween, said cooperating means including projections on each of said transition sleeve and the inside surface of said wand shell.

13. The pullout faucet wand joint of claim 12 wherein said reinforcing collar includes an outwardly extending arcuate projection at one end thereof, which projection cooperates with an inwardly directed rib on an inside surface of said receptor to secure said elements one to the other.

14. The pullout faucet wand joint of claim 13 wherein said reinforcing collar includes a further outwardly extending projection overlying the end of said receptor.

15. The pullout faucet wand joint of claim 12 wherein said reinforcing collar has at least one orientation notch formed on the interior surface thereof, with said faucet wand having an axial projection which extends into said orientation notch to provide relative orientation between the faucet wand and receptor.

16. The pullout faucet wand joint of claim 12 wherein the faucet wand waterway includes an outwardly extending axial projection which cooperates with an axially extending slot on the transition sleeve to provide relative orientation therebetween.

* * * * *